United States Patent [19]

Kumazawa

[11] 4,000,384

[45] Dec. 28, 1976

[54] UNLOCKING MECHANISM

[75] Inventor: Shoichiro Kumazawa, Kamagaya, Japan

[73] Assignee: Kabushiki Kaisha Seikosha, Japan

[22] Filed: Sept. 9, 1974

[21] Appl. No.: 504,361

[30] Foreign Application Priority Data

Sept. 11, 1973 Japan ..... 48-106513[U]

[52] U.S. Cl. ..... 200/37 R; 200/36; 58/19 A; 58/23 D

[51] Int. Cl.[2] ..... H01H 43/10

[58] Field of Search ..... 200/11 E, 11 EA, 11 G, 200/35 R, 36, 37 R, 258–261, 37 A; 58/19 R, 19 A, 19 B, 23 R, 23 D, 33, 38, 16, 20, 22

[56] References Cited

UNITED STATES PATENTS

| | | | |
|---|---|---|---|
| 3,028,456 | 4/1962 | Smith | 200/36 |
| 3,596,013 | 7/1971 | Pihl | 200/11 EA |
| 3,643,421 | 2/1972 | Herr et al. | 58/19 A X |

*Primary Examiner*—James R. Scott
*Attorney, Agent, or Firm*—Robert E. Burns; Emmanuel J. Lobato; Bruce L. Adams

[57] ABSTRACT

A rotary switch for a timepiece in which a rotatable setting plate made of non-conductive material has fixed thereon a plurality of upstanding projections of equal axial height on a major surface thereof resiliently supporting coaxially thereon on the tips of the projections an electrically conductive contact gear driven rotationally by an hour gear of a timepiece. The setting plate carries an electrically conductive contact plate thereon that has upstanding angularly spaced contacts of lesser axial height than the upstanding projections. These contacts are angularly spaced from each other differently than the angular spacing of the upstanding projections and are disposed among and alternately with the upstanding projections. The contact gear is biased toward the projections by a resilient spring so that it travels substantially in parallelism with the setting plate and when a first set of through openings are in registry with the corresponding upstanding projections the projections will penetrate these openings and the contact gear will be moved axially so that it then seats on the upstanding contacts and rides thereon making electrical connection therewith. The contact gear has a second set of through openings that come into registry with the upstanding contacts and these will then penetrate these second openings and the electrical connection will then be broken. The upstanding projections have ramp surfaces engaged by a corresponding opening of the first set of openings so that the travelling contact gear travels up the ramps and is again seated on the tips of the upstanding projections for repeating the making and breaking of the electrical connection. Means are provided for setting the setting plate in any desired angular position relative to the contact gear. The upstanding projections are resiliently joined to the setting plate and each have a rear extension that rides resiliently on a fixed base plate.

5 Claims, 12 Drawing Figures

UNLOCKING MECHANISM

The present device relates to an unlocking mechanism of a rotary switch of an alarm of a timepiece.

In a conventional unlocking mechanism of a rotary switch a contact point is provided at the end portion of an unlocking lever which pushes an hour gear wheel to an unlocking gear wheel.

Such a conventional mechanism has a defect in that to regulate the contact pressure of the unlocking lever is difficult, since the contact point is provided at the end portion of the unlocking lever and the pressure applied to the hour gear wheel by the middle portion of the unlocking lever is stronger than the contact pressure thus applying a heavy load to the gear train of the timepiece. Further, a load is applied to the gear train when the hour gear wheel slidably mounts the slope of projection formed on the unlocking gear wheel. Further more, a conventional defect is that the locked state continues for twenty to thirty minutes, in another words, it takes about twenty to thirty minutes from the closing of the contact point to the opening, and noise occurs if such unlocking mechanism is employed in a radio since the contact point gradually opens.

SUMMARY OF THE INVENTION

The present device intends to eliminate the disadvantages described above.

An object of the present invention is to provide an effective, efficient, easily constructed rotary switch for a timepiece.

Figure 1:
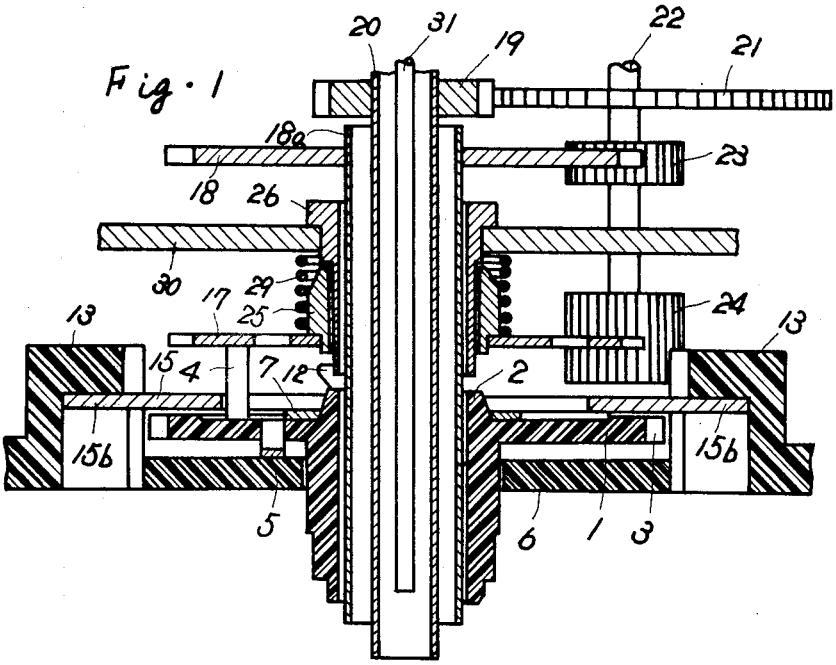
FIG. 1 is an elevation section view of a rotary switch according to the invention.

Other objects and advantages will appear from the following description of an example of the invention, and the novel features will be particularly pointed out in the appended claims.

DESCRIPTION OF THE PREFERRED EMBODIMENT

Referring to the drawings one embodiment will be described.

Figure 2:
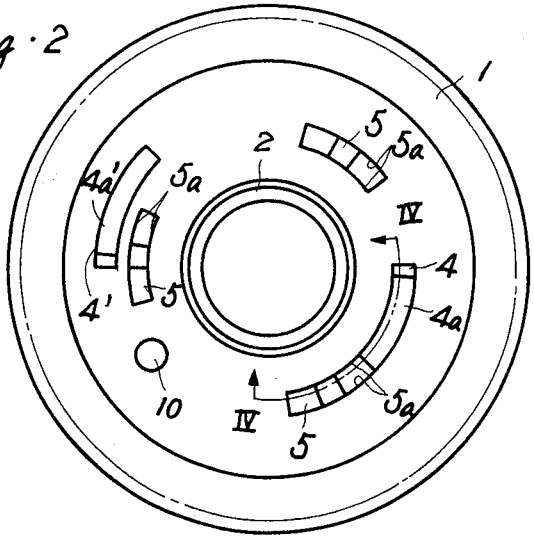
FIG. 2 is a plan view of a setting plate in the rotary switch in FIG. 1.
Figure 3:
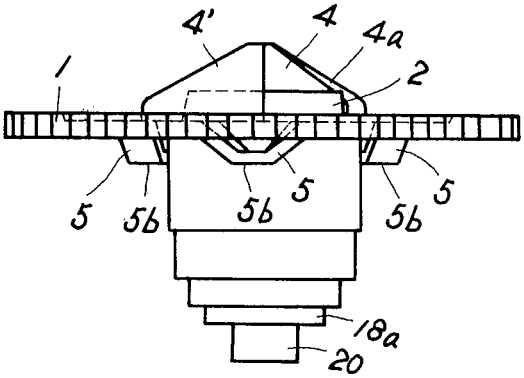
FIG. 3 is a side elevation view of the setting plate in FIG. 2.
Figure 4:
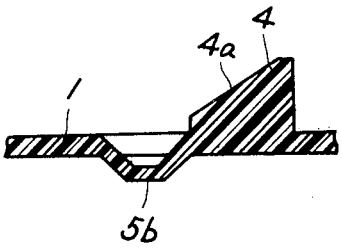
FIG. 4 is a section view taken along section line IV—14 in FIG. 2.
Figure 5:
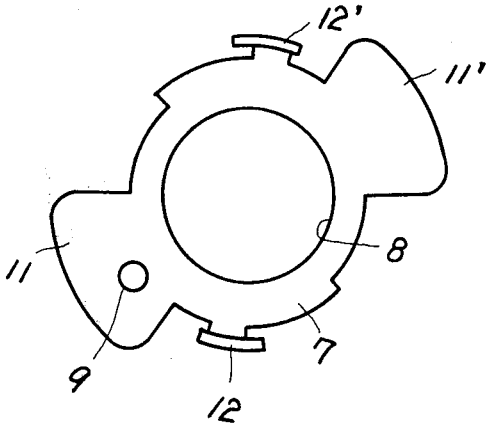
FIG. 5 is a plan view of a contact plate in the rotary switch in FIG. 1.
Figure 6:
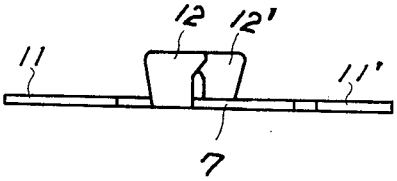
FIG. 6 is a fragmentary side elevation view of the contact plate in FIG. 5.
Figure 7:
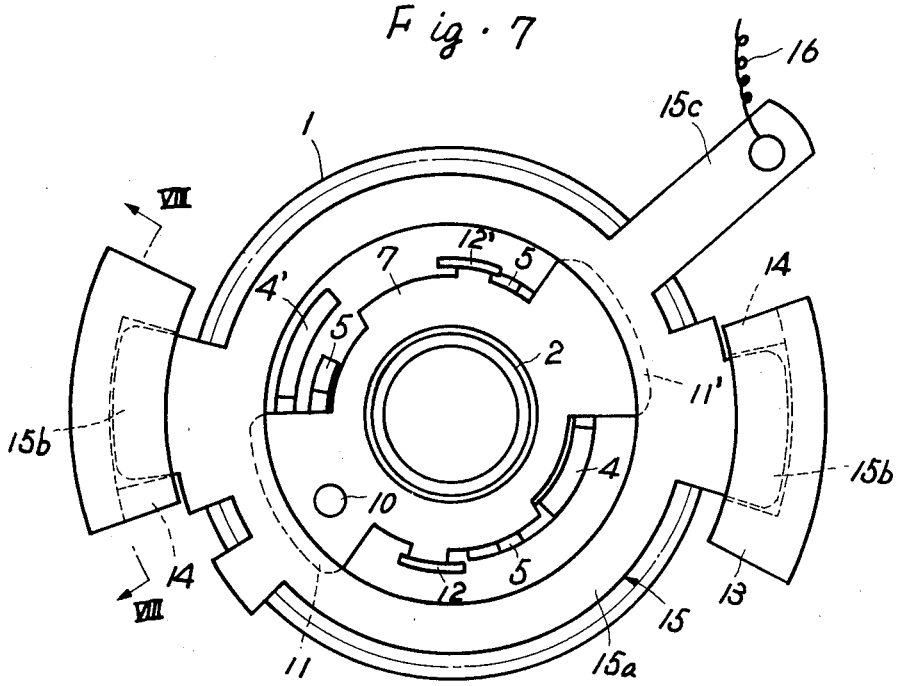
FIG. 7 is a plan view of a part of the rotary switch in FIG. 1 and illustrates the relation of a base plate, a setting plate, an alarm contact plate and a holding plate therefor.
Figure 8:
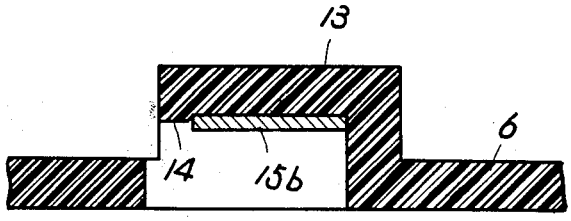
FIG. 8 is a section view taken along section line VIII—VIII in FIG. 7.
Figure 9:
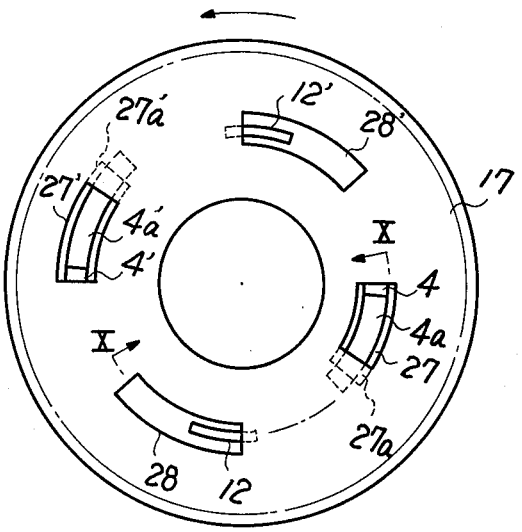
FIG. 9 is a plan view of a contact gear and a setting plate in the rotary switch in FIG. 1.
Figure 10:
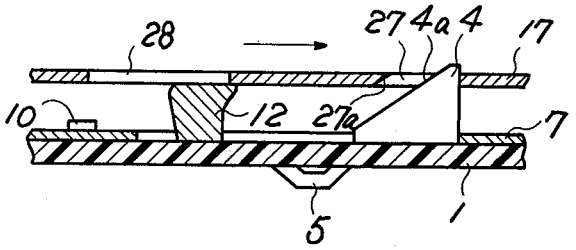
FIG. 10 is a section view taken along section line X—X in FIG. 9.

Referring to FIGS. 1 to 3, an unlocking gear wheel 1 is made of synthetic resin and is provided integrally with an unlocking gear wheel sleeve 2. A toothed portion 3 is formed on the periphery of the unlocking gear wheel 1. Unlocking projections upstanding 4, 4 are formed on the upper surface of the unlocking gear wheel 1. The projections 4, 4 are triangularly shaped in cross section as shown in FIG. 4 and they are respectively provided with slopes 4*a*, 4*a*. The unlocking gear wheel 1 is provided with three bridge-shaped projections 5 — equidistantly angularly spaced from each other. Each projection 5 is formed by two cuts 5*a*, 5*a* in the unlocking gear wheel 1, and as is clearly shown in FIG. 4, it extends downwardly from the unlocking gear wheel 1. Bottom surface 5*b* of each projection 5 comes into contact with a base plate 6. An alarm contact plate 7 is secured to the upper surface of the unlocking gear wheel 1. Referring especially to FIGS. 5 and 6, the alarm contact plate 7 is provided with a hole 8 through which the unlocking wheel sleeve or hub 2 penetrates, and a small hole 9 which engages with a pin 10 provided on the unlocking gear wheel 1. The alarm contact plate 7 is provided with two sliding portions 11, 11′ extending outwardly. Two alarm contacts 12, 12′ are vertically formed at diametrically opposite positions of the alarm contact plate 7. The base plate 6 is made of non-electroconductive material and is provided with two clasp means 13, 13. As is clearly shown in FIGS. 1 and 8, each clasp means 13 is hook-shaped in section and a projection 14 is formed at the lower side of the edge portion. The projections 14, 14 function as a stop when holding plate 15 is engaged with the clasp means 13, 13. The holding plate 15 is made of electrically conductive spring material. The holding plate 15 consists of a ring extension 15*a*, engaging flanges 15*b*, 15*b* and lead portion 15*c* or arm. Through a center hole inside the ring portion 15*a*, the unlocking projections 4, 4 and the alarm contacts 12, 12′ penetrate. The ring portion 15*a* pushes the sliding portions 11, 11′. The engaging flanges 15*b*, 15*b* are to be clasped by the clasp means 13, 13. At the end of the lead arm 15*c*, a lead wire 16 is connected. A contact gear wheel 17 rotates at the same constant speed with an hour gear wheel 18. The contact gear wheel 17 is made of electroconductive material. The gear train between the contact gear wheel 17 and the hour gear wheel 18 will be explained. A minute wheel pinion 19 is secured to a minute wheel sleeve 20. The minute wheel pinion 19 is engaged with an intermediate gear wheel 21. The intermediate gear wheel 21 is secured to an intermediate gear wheel arbor 22. An intermediate pinion 23 is also secured to the arbor 22. The intermediate pinion 23 meshes with the hour gear wheel 18. The hour gear wheel 18 is secured to an hour gear wheel sleeve 18*a*. To the lower end portion of the arbor 22, a transmission pinion 24 is secured which meshes with the contact gear wheel 17. This pinion 24 has as many teeth as the intermediate pinion 23. The contact gear wheel 17 is connected to a washer 25, which is further loosely supported about an hour gear wheel sleeve support 26. The contact gear wheel 17 has as many teeth as the hour gear wheel 18. Therefore the contact gear wheel 17 rotates at the same speed as the hour gear wheel 18. As is clearly shown in FIG. 9, the contact gear wheel 17 is provided with holes 27, 27′ in a diametrically opposite position through which the unlocking projections 4, 4 may protrude, and holes 28, 28′ in a diametrically opposite position through which the alarm contacts 12, 12 may protrude. A bevel or slope 27*a* is formed at one side of each hole 27 as shown in FIG. 10. A hole 27 and a hole 28 are angularly spaced apart by an angle of $\alpha$ degrees and in the present invention $\alpha$ is ninety. Whereas the unlocking projection 4 and the alarm contact 12 are spaced apart by an angle of $\beta$ degrees. $\alpha$ is so designed that it is a little more than $\beta$. By designing $\alpha$-$\beta$ at a desired degree, the closed period of the contacts is determined. A coil spring 29 is provided about the washer 25. The lower end portion of the coil spring 29 is curled to form a diameter shorter than that of the washer 25 thus holding the washer firmly. The upper end portion of the coil spring 29 is bent so that it may not hurt the lower plate 30. Further the plane including the circle of the lower end portion of the coil spring 29 is parallel to the plane including the circle of the upper end portion of the coil spring. The force of the coil spring 29 is desirably determined to a degree necessary for contact pressure. Inside the minute wheel pipe 20, a second hand arbor 31 is provided.

Figure 11:
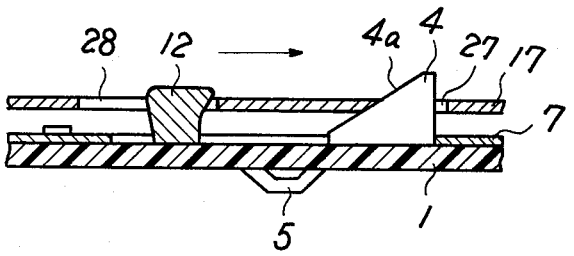
FIGS. 11 and 12 are fragmentary section views illustrating the elements of FIG. 10 in different operative positions for closing and opening the rotary switch according to the invention.
Figure 12:
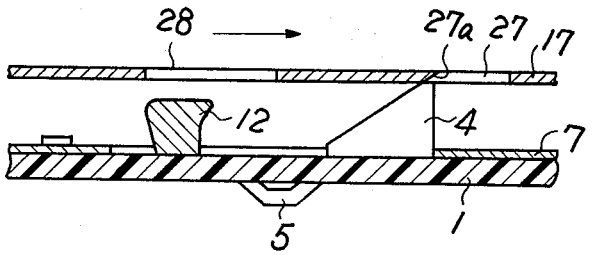

In operation, when a rotational force, stronger than the static friction force between the bridge-shaped projections 5 — and the base plate 6, is manually applied to the unlocking gear wheel 1, the unlocking and functions as a setting plate or gear wheel 1 rotates sliding on plate on the bottom surfaces 5*b*. Since the unlocking gear wheel 1 is pushed by the holding plate 15 and the applied friction torque is large enough so that the gear wheel may not be rotated by the hour gear wheel sleeve 18*a*. Thus the alarm time is set. As the hour gear wheel 18 rotates, the contact gear wheel 17 also rotates. Since the contact gear wheel 17 is pushed downwards by the coil spring 29, the gear wheel assumes proper posture parallel to the base plate 1 during its rotation. The unlocking projections 4, 4 support the contact gear wheel 17 against the spring force of the coil spring 29. When the contact gear wheel 17 rotates to the position, shown in FIG. 10, where the holes 27, 27′ face or are in registry with the unlocking projections 4, 4 the contact gear wheel 17 moves down under the force of the coil spring 29. The unlocking projections 4, 4 penetrate the holes 27, 27′. At this time, the contact gear wheel 17 is supported by the alarm contacts 12, 12″as shown in FIG. 10 and the contacts are closed. The pressure of the contacts 12, 12′ against the contact wheel 17 is desirably adjusted by controlling the spring force. The state in which the contacts have just closed is shown in FIG. 9. The alarm contacts 12, 12′ support the contact gear wheel 17 by the central angle of $\alpha$-$\beta$ degrees. When the contact wheel 17 has further rotated, to the position shown in FIG. 11, by the angle of $\alpha$-$\beta$ degrees in the direction shown by an arrow in FIG. 9, the holes 28, 28′ face or are in registry with the alarm contacts 12, 12′ and the contact gear wheel moves down. The slopes 27*a*, 27*a* of the holes 27, 27′ abut the slopes 4*a*, 4*a* of the unlocking projections 4, 4, thus the contact gear wheel 17 is driven upwardly and supported by the unlocking projections 4, 4 to the position shown in FIG. 12. Accordingly the contacts are instantly opened. Since the contacts are closed during the time required for the contact wheel 17 to rotate by the angle of $\alpha$-$\beta$ degrees, it is easy to control the closed time by changing the central angle $\alpha$ between the hole 27 and the hole 28. As the contact wheel 17 further rotates, the slopes 27*a*, 27*a* slide up the slopes 4*a*, 4*a* of the projections 4, 4 until it comes to the former position remote from the unlocking wheel 1.

According to the present device, since the opening and the closing operation of the contacts is performed by the contact gear wheel and the alarm contacts, the spring force applied to the gear wheel will be sufficient if is strong enough for the contact operation. And the spring force gives little load to the gear train of the timepiece. As the contacts are instantaneously opened when the alarm contacts fall into the holes provided in the contact gear wheel, there occurs no oxidization of the contacts or noise due to spark. Further the period of time when the contacts are closed is easily controlled by changing the relation between the angle of $\alpha$ degrees and the angle of $\beta$ degrees.

What is claimed is:

1. A rotary switch comprising, a stationary base plate, an electrically non-conductive rotatable setting plate having angularly spaced upstanding projections of equal height on a major surface thereof and having resilient rear extensions resiliently bearing on said base plate, an electrically conductive contact plate mounted on said setting plate for angular positioning thereof in dependence upon the angular position of the setting plate and having means for making an electrical connection therewith, said contact plate having angular spaced contacts upstanding in the same direction as said projections and of lesser height than said projections and angularly spaced therefrom and electrically conductive driven contact gear driven in operation for selectively making and breaking an electrical connection with the upstanding contacts and disposed coaxially with said setting plate seated on tips of said upstanding projections for sliding frictionally thereon in substantial parallelism with the setting plate, resilient means resiliently biasing the driven contact gear into engagement with said upstanding projections, said contact plate having a first set of through openings angularly spaced for receiving the projections therein when in registry therewith thereby allowing axial travel of said contact plate for seating on said upstanding contacts for making electrial connection therewith and having a second set of through openings disposed angularly spaced dispersed intermediate and alternately of the first set of openings for receiving the upstanding contacts when in registry therewith for breaking said electrical connection when said upstanding contacts are received in said second set of openings, said upstanding projections having ramp surfaces on a side thereof for engagement by edges of the first set of through openings for travelling on corresponding ramp surfaces against the force of said resilient means and seating on the tips of said upstanding projections, and means for variably angularly positioning the rotatable setting plate to different angular positions for resting thereat stationarily thereby variably setting the time at which said connection will be made.

2. A rotary switch according to claim 1, including holding means made of electrically conductive material elastically biasing the rotational first plate and said contact plate towards the base plate.

3. A rotary switch according to claim 1, in which said first plate comprises a gear.

4. A rotary switch according to claim 1, including a timepiece mechanism including an hour gear driving the contact gear.

5. A rotary switch according to claim 1, in which the edges of said first set of through openings engaging said ramp surfaces comprise bevelled edges.

* * * * *